US005905224A

United States Patent [19]

Jordan

[11] Patent Number: 5,905,224

[45] Date of Patent: May 18, 1999

[54] PULLEY BELT MAGAZINE

[75] Inventor: Gerhard Paul William Jordan, Millbrae, Calif.

[73] Assignee: Paul William Jordan, Millbrae, Calif.

[21] Appl. No.: 09/100,194

[22] Filed: Jun. 18, 1998

[51] Int. Cl.[6] ..... F41A 9/34

[52] U.S. Cl. ..... 89/33.02; 89/33.14; 89/34

[58] Field of Search ..... 89/33.02, 33.14, 89/33.16, 33.17, 33.1, 34

[56] References Cited

U.S. PATENT DOCUMENTS

| | | | |
|---|---|---|---|
| H592 | 3/1989 | Gillum | 89/46 |
| 2,114,311 | 4/1938 | Nomar | 89/33.17 |
| 2,241,290 | 5/1941 | Brandt | 89/34 |
| 2,569,798 | 10/1951 | Carroll | 89/33.14 |
| 4,026,212 | 5/1977 | Dardick | 102/39 |
| 4,056,062 | 11/1977 | Walser et al. | 102/86.5 |
| 4,139,959 | 2/1979 | Howard et al. | 42/50 |
| 4,384,508 | 5/1983 | Sullivan et al. | 89/33.02 |
| 4,445,418 | 5/1984 | Sullivan et al. | 89/33.02 |
| 4,445,419 | 5/1984 | Fischer | 89/33.02 |
| 4,468,875 | 9/1984 | Harrison et al. | 42/50 |
| 4,565,114 | 1/1986 | Burdick et al. | 89/35.01 |
| 4,658,700 | 4/1987 | Sullivan | 89/33.02 |
| 4,672,760 | 6/1987 | Chesnut et al. | 42/50 |
| 4,681,019 | 7/1987 | Brandl et al. | 89/33.14 |
| 4,686,887 | 8/1987 | Schiele | 89/33.16 |
| 4,742,756 | 5/1988 | Mannhart | 89/33.02 |
| 4,745,842 | 5/1988 | Shou-Fu | 89/33.02 |
| 4,833,969 | 5/1989 | Winkler et al. | 89/36.13 |
| 4,926,742 | 5/1990 | Ma et al. | 89/33.02 |
| 5,259,290 | 11/1993 | Pehker | 89/35.01 |
| 5,353,679 | 10/1994 | Nordmann | 89/34 |
| 5,398,590 | 3/1995 | Snyder, Sr. | 89/33.02 |

FOREIGN PATENT DOCUMENTS

| | | | |
|---|---|---|---|
| 677117 | 6/1939 | Germany | 89/33.02 |
| 1553877 | 8/1971 | Germany | 89/33.02 |
| 536873 | 5/1941 | United Kingdom | 89/33.17 |
| 8700614 | 1/1987 | WIPO | 89/33.02 |

OTHER PUBLICATIONS

Monty Mendenhall, Nov. 1995, The Beta C Magazine, pp. 30–31, Machine Gun News.

Charlie Cutshaw, Aug. 1998, Bundeswehr Battle Rifle, pp. 46–47, Soldier of Fortune.

*Primary Examiner*—Stephen M. Johnson

[57] ABSTRACT

This invention is in reference to ammunition feeding devices for guns, specifically magazines. The belt feed mechanism consists of a container, which stores the ammunition and defines the path which the ammunition band moves the ammunition. The ammunition is pulled by the ammunition band which is pulled onto one spool. The spool is driven by the power of a wound up spring. Two or more mechanisms can be coupled together, to form a system. The spring motor can be loaded externally through rotating an axle which is attached to a direction limiting mechanism while loading spring motor. The spring motor is discharged controllably utilizing a free gear friction brake by pushing an axle. The spring motor is disengaged from the belt with a push button. Dummy cartridges are used to forward ammunition when the belt itself does not deliver all cartridges by itself.

28 Claims, 15 Drawing Sheets

PULLEY BELT MAGAZINE

BACKGROUND

1. Field of Invention

This invention relates to magazines for firearms. More particularly, it relates to a magazine which can store and deliver a plurality of cartridges toward the firing chamber of a firearm.

2. Background of the Invention

Magazines for guns can be separated into two categories, belt fed and spring follower.

Originally, removable box magazines were designed as single stack. Later staggered box magazines were made. Both of these magazines were straight or curved. These magazines deliver ammunition to the gun with a spring, which usually pushes the cartridges toward the gun. The spring pushes or pulls the ammunition, guided by the inner wall surface of the magazine, toward the chamber of the weapon. U.S. Pat. No. 4,139,959 to Howard, Harvey (1979) discloses a plastic magazine which utilizes a push spring and a follower to push the cartridges out of the magazine.

These magazines are limited in capacity because of spring power restrictions or friction restrictions. Magazine capacity can only be increased by lengthening the magazine, usually along the axis perpendicular to the direction which the gun fires. Even if a box magazine can solve the spring and friction problems in a high capacity magazine, the magazine would be considerably long and unwieldy.

Although box magazines are inexpensive to manufacture, considerably reliable, simple to load, simple to operate, and simple to put into or remove from the weapon, they do not possess the ability to store and deliver a high quantity of ammunition to the weapon in a reliable manner. They also do not store high quantities of ammunition in a compact, ergonomic manner.

These magazines are limited in capacity because of spring power restrictions, friction restrictions or size restrictions. Magazine capacity is usually less than a drum magazine of the same size.

Another way which ammunition can be delivered to a weapon is by feeding the ammunition to the chamber with a belt magazine. These mechanisms usually use a spring drive and axle to move a belt. The belt has spaced shelves which hold cartridges individually. U.S. Pat. No. 4,468,875 to Harrison, Retzlaff(1984) discloses a removable magazine powered by a spring motor that is directly attached to the axle to drive an endless plastic band which carries the cartridges in inserts directly to the chamber.

Drum type magazines are also a way which a considerably high quantity of ammunition can be stored and delivered to the weapon. The drum type magazine can be configured as single drum or double drum. The magazine operates by pushing ammunition about the centroidal axis of the drum with a loaded spring and a rotor arm. U.S. Pat. No. 658,700 to Sullivan (1987) discloses a double drum magazine and a single drum magazine which is capable of storing and delivering a staggered ring of cartridges with the power of a spring and rotor arm.

U.S. Pat. Nos. 4,745,842; 4,384,508; and 4,445,418 have been considered but they were found deficient for ergonomic, capacity utilization, and space utilization reasons.

The drum type magazine has some imperfections. The magazine is usually difficult to load, especially without a special tool, due to the powerful spring. The spring loaded pusher arm puts a great deal of friction between the ammunition and the inside surface of the drum magazine. This can be a problem when using ammunition which is not good (reloaded or damaged ammunition). The hub, where the spring is stored on the axis of the drum, is rather large and occupies a space which can not be used to store ammunition. As a result, it takes a significantly larger space to store ammunition in a drum magazine than in other methods. Although drum magazines carry and deliver a relatively high capacity in a portable manner, they do not optimize the size of the magazine to capacity of the magazine. They are also rather difficult and time consuming to load without tools. Reliability may also be compromised when using less than perfect ammunition.

SUMMARY OF THE INVENTION

It is an object of this invention to provide a removable cartridge magazine that carries a plurality of cartridges, driven by a spring motor, toward the firing chamber of a firearm.

It is another object of this invention to provide such a magazine which has a pulley belt. The pulley belt is flat, wide, long and is nested in the magazine in such a manner as to loop around all the live cartridges which are to be delivered to the firing chamber of a firearm. Furthermore, the final objective of this invention is to provide a compact and ergonomic device.

These objectives are accomplished preferably by providing a removable magazine. This removable magazine is comprised of a single drum or double drum. Each drum is comprised of linear, arc or a combination of two or more of these path formats. The belt is attached to a rotating axle at one end and the other end of the band is fixed to the magazine. The band is placed between the inner periphery wall and the cartridges, the outer periphery of the wall and the cartridges and behind all cartridges to be delivered to the firing chamber of the firearm. Rotation of rotating axle causes the band to pull the cartridges toward the firing chamber of the firearm. The spring motor is charged externally through a rotatibly mounted axle that is attached to a direction limiting mechanism while the spring motor is being loaded.

The spring motor is discharged controllably utilizing a free gear as a friction brake by linearly moving the main gear or transmission gear/free gear system. The spring motor is disengaged from the belt with a push button. Dummy cartridges are used when the belt does not deliver all cartridges by itself

DESCRIPTION OF THE PREFERRED EMBODIMENTS

The preferred embodiments are now described with reference to the drawings in which like numbers indicate like parts throughout the views.

Figure 1:
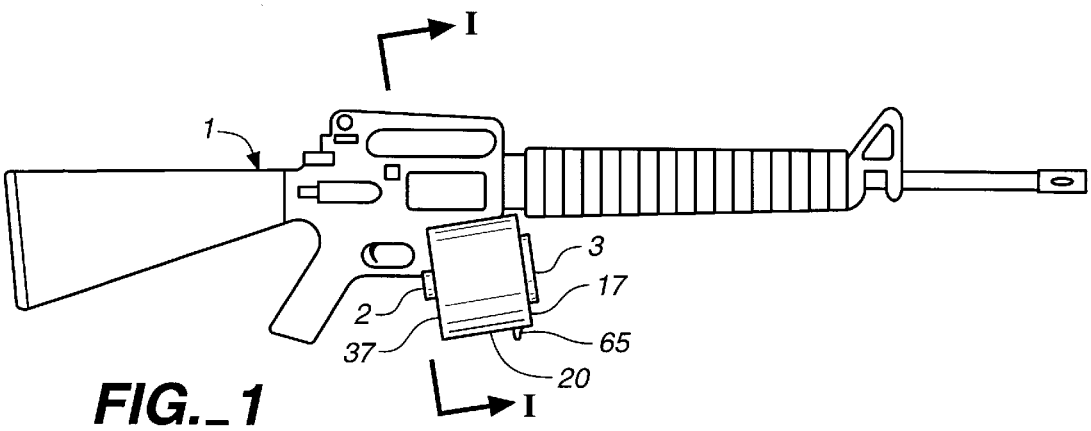
FIG. 1 is a vertical view of the firearm having the magazine attached thereto.
Figure 2:
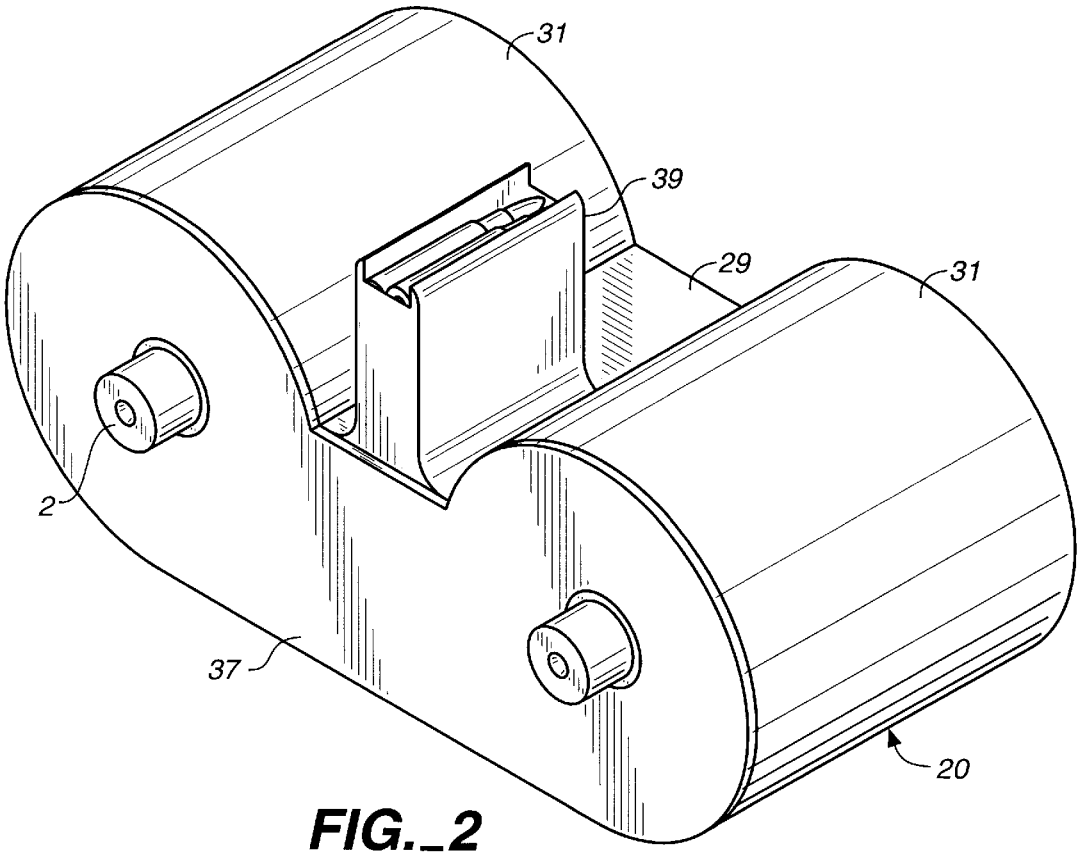
FIG. 2 is a perspective view taken along line I—I of FIG. 1 showing the double drum magazine alone of the invention.

FIG. 2 shows the double drum magazine 20 which includes two drum portions, 31 connected together by upper connection means 29, and lower connection means 30, and a cartridge feed extension (or delivery section) 39 attached to said upper connection means 29. FIG. 1 shows the double drum magazine attached to a rifle 1, such as an AR-15.

Figure 11:
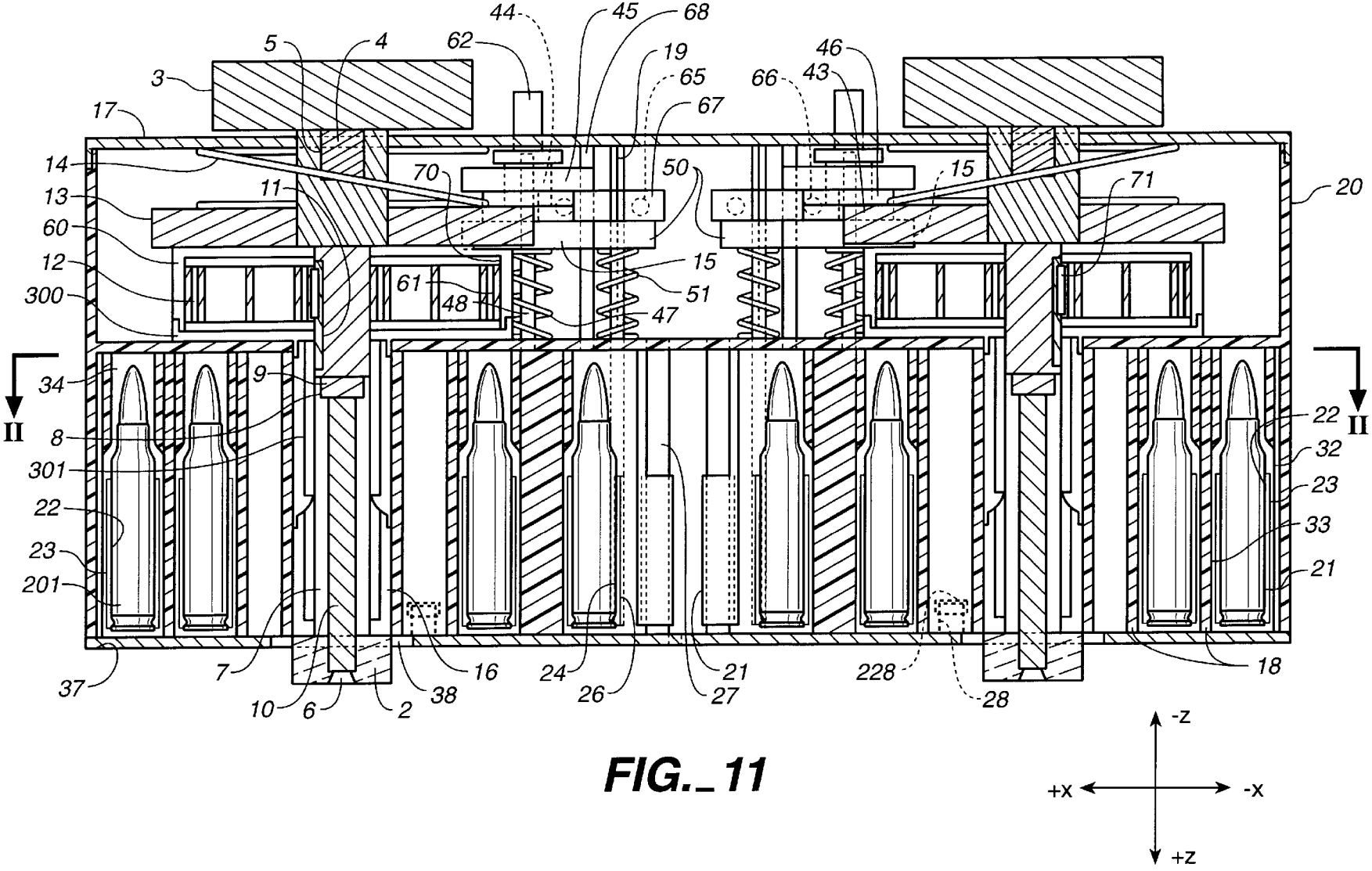
FIG. 11 is a section along lines IV—IV of FIG. 2 showing the double drum magazine fully loaded with gears engaged and in standard position.

FIG. 11 shows in detail a double drum embodiment of the present invention. Each drum portion is essentially an identical mirror image of the other. Each drum has a centrally located driving mechanism consisting of a rear turning handle 2 with a discharging hole 6, fixedly attached to the cylinder shaft 7 which has an inward facing gear coupling (8) when the main gear is in the farthest +z direction as possible. Said outward facing gear coupling 9 is fixedly attached to the main (motor) shaft 10 and the main gear 13. Said main gear 13 is fixedly attached to the female piece 5 which engages the male piece 4, which is fixedly attached to the front turning handle 3. It can be seen, said female piece 5 engages the said male piece 4, when said front turning handle 3 is put in the farthest +z position as possible. Said driving mechanism which consists of rear turning handle 2, discharging hole 6, cylinder shaft 7, inward facing gear coupling (8), main shaft 10, main gear 13, female piece 5, male piece 4, and front turning handle 3, are all rotatibly mounted in the cylinder shaft housing 16 and the spring motor housing 60.

The cylinder shaft housing 16, is fixedly attached to the spring motor housing 60.

The cylinder shaft housing 16, cylinder shaft housing connector 301, spring motor housing connector 300, and spring motor housing 60 are fixedly attached to magazine 20. The spring motor housing 60 contains a drive spring 12. One end of the drive spring 12 is attached to the cylinder shaft 7, the other end of the drive spring 12 is attached to the spring motor housing 60. The shaft spring receptacle 11 located on the main shaft 10, attached to spring end 71 which is part of the drive spring 12. The other end of drive spring 12 consists of a spring end housing attachment 61 which attaches to the spring motor housing attachment 70 which is part of the spring motor housing 60. The main gear push spring 14 keeps the said driving mechanism in place by pushing it in the +z direction and allows proper pressure for discharge of the said drive spring 12 and/or disengagement of said driving mechanism from rotating (or windup) axle 19.

Figure 12:
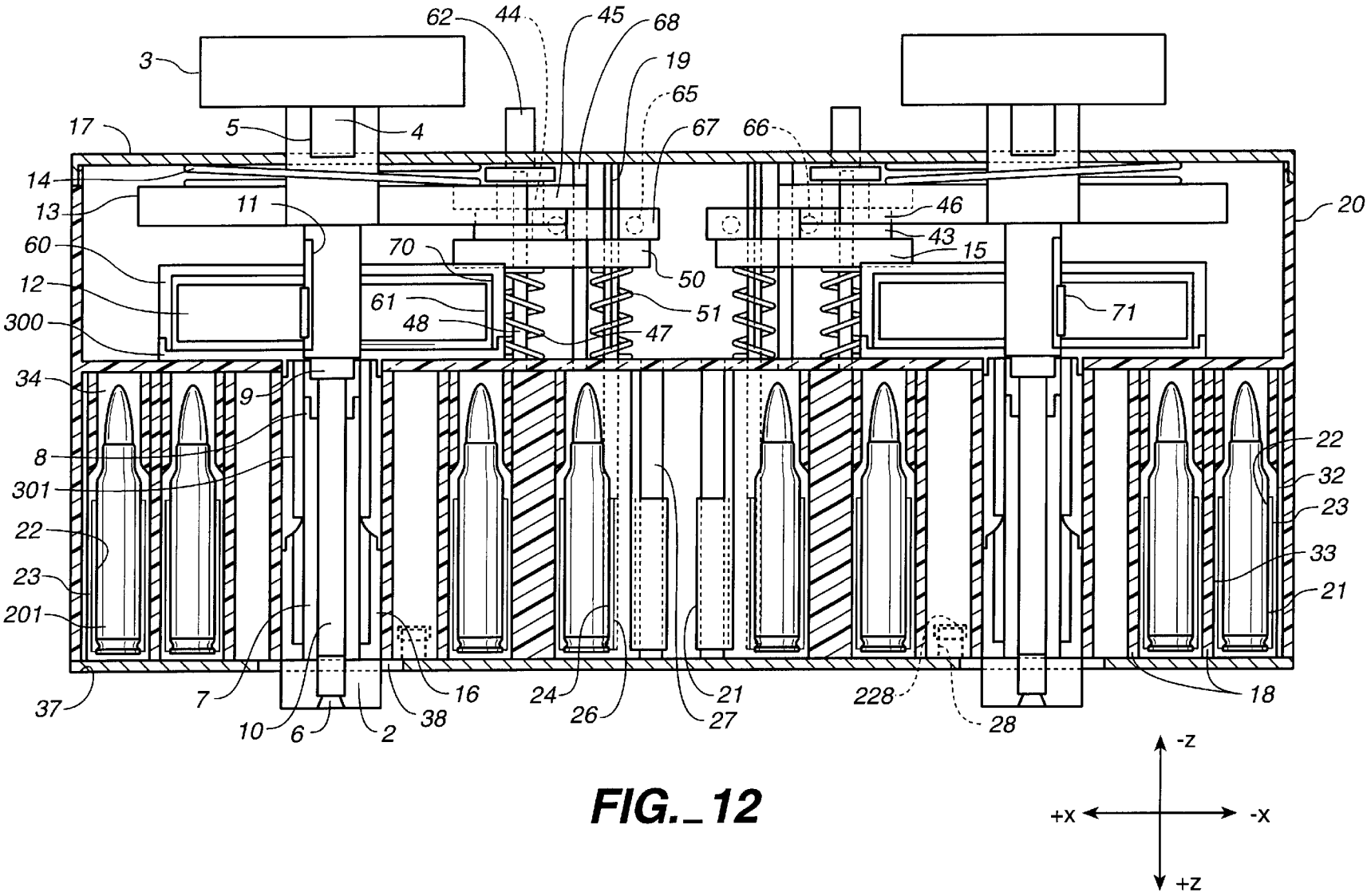
FIG. 12 is a section along lines IV—IV of FIG. 2 showing the double drum magazine fully loaded with displaced main gear.
Figure 13:
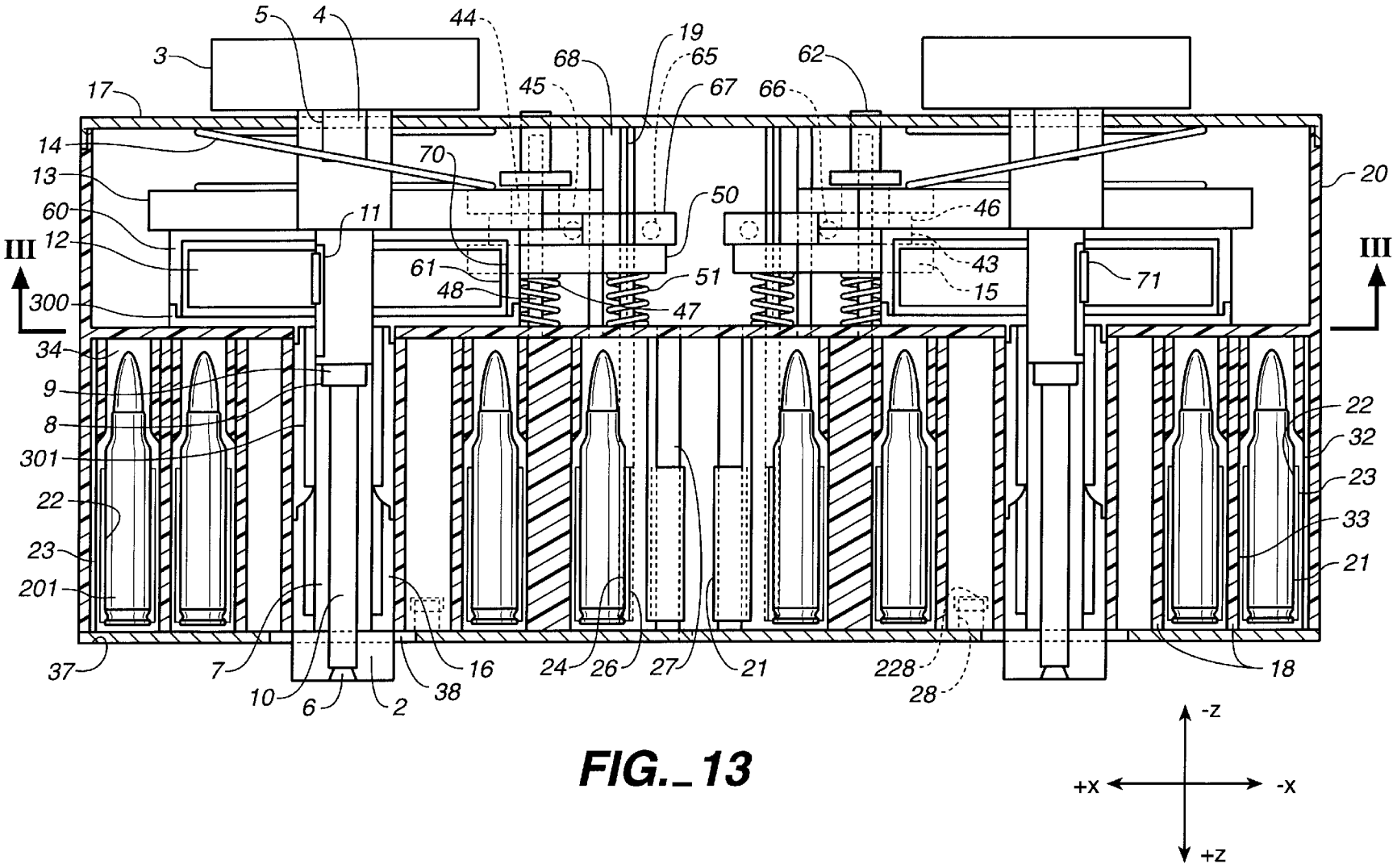
FIG. 13 is a section along lines IV—IV of FIG. 2 showing the double drum magazine fully loaded with displaced transition gear and displaced free gear.

FIG. 12 shows the drive spring 12 and main gear 13 can be discharged and/or disengaged from the rotating (or windup) axle 19 by depressing said main shaft in the −z direction which disengages said inward facing gear coupling 8 from said outward facing gear coupling 9 and (disengages) main gear 13 from transfer gear 15 and main gear 13 engages free gear (45) and ratchet 67 must be disengaged. FIG. 13 shows the drive spring 12 and main gear 13 can also be discharged or disengaged from said rotating axle 19 by depressing the transition gear button 62 in the +z direction.

FIG. 11 shows the said driving mechanism transfers its energy to the rotating axle 19 through a transmission system. The main gear 13 engages transfer gear 15 when the inward facing gear coupling 8 engages outward facing gear coupling 9 and the transition gear button 62 is in the released button. Said transfer gear 15 is fixedly attached to ratchet gear 43 and free gear shaft 44. Said transfer gear 15, ratchet gear 43 and free gear shaft 44 are rotatibly mounted on fixed axle 48. Said fixed axle 48 is fixedly mounted on to magazine 20. Free gear 45 is fixedly attached to ratchet gear 46. Free gear 45 and ratchet gear 46 is rotatibly mounted on free gear shaft 44. Transition gear button 62 allows the transverse motion of said transfer gear 15, ratchet gear 43, free gear 45, axle gear 50, and ratchet gear 46 along the z axis.

FIG. 13 shows that when the transition gear (button) 62 in the depressed position, transfer gear push spring 47 is compressed and said free gear 45 is engaged with said main gear 13 when said external gear coupling 9 is engaged with said internal gear coupling 8. Said transition gear button 62 is in the released position, or the depressed position the axle gear 50 engages transfer gear 15, also ratchet 67 is able to engage ratchet gear 43 and ratchet gear 46 when ratchet button 65 is depressed.

FIG. 11 shows that when the transition gear button 62 is in the released position, said transfer gear 15 is engaged with said main gear 13 when said (outward facing gear coupling) 9 is engaged with said (inward facing gear coupling) 8.

FIG. 13 shows the transverse gear push spring 47 keeps the said transfer gear 15, ratchet gear 43, free gear 45, and ratchet gear 46, in position on the z axis and allows proper pressure for discharge of said driving spring 12.

Figure 9:
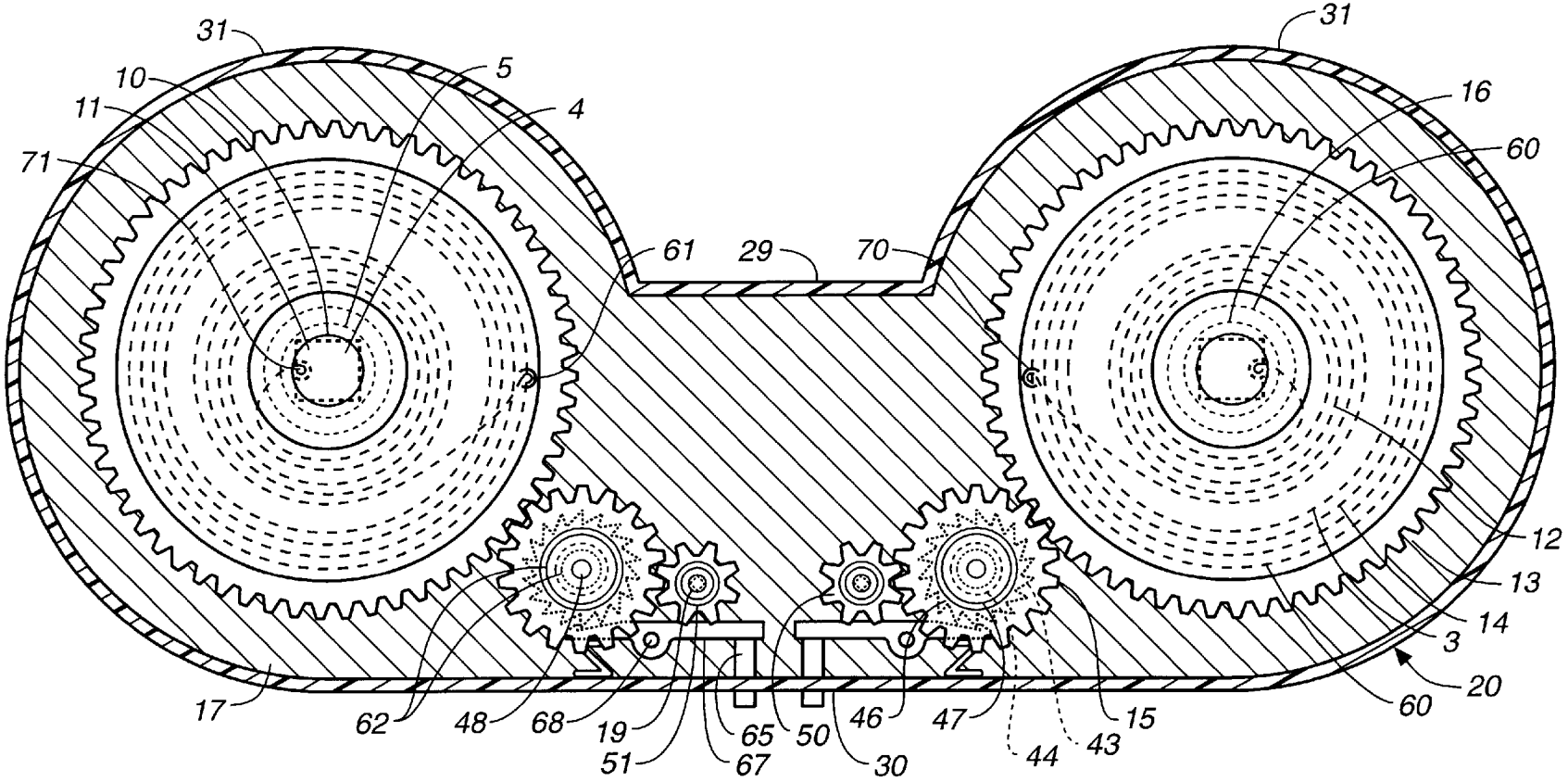
FIG. 9 is a vertical view in cross-section along line III—III of FIG. 2 showing the double drum magazine alone of the invention with gears and ratchets exposed and ratchets engaged.
Figure 10:
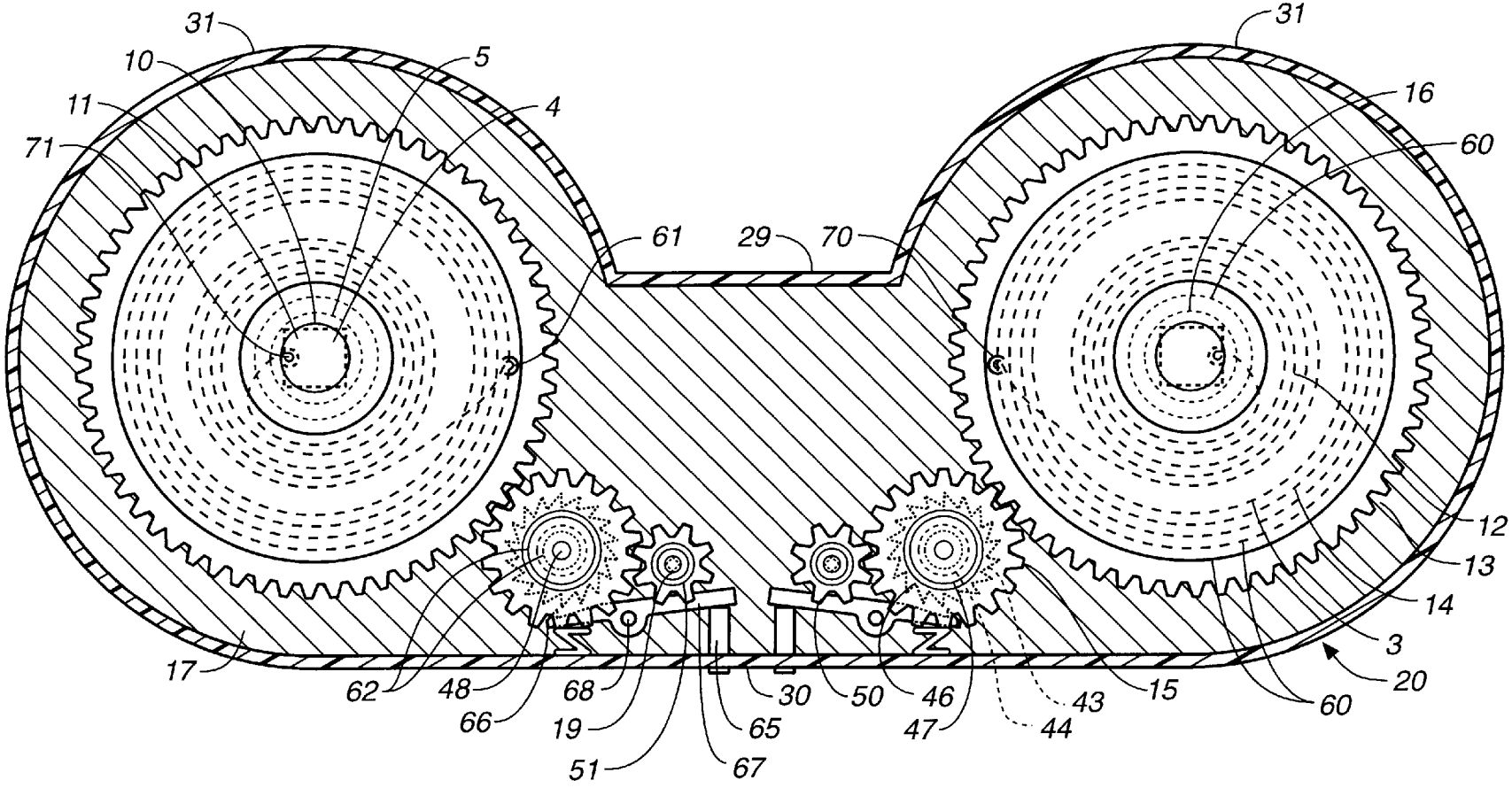
FIG. 10 is a vertical view in cross-section along line III—III of FIG. 2 showing the double drum magazine alone of the invention with gears and ratchets exposed and ratchets disengaged.

Ratchet 67 is rotatibly mounted on ratchet axle (68). FIG. 9 shows that when the ratchet button 65 is in the released fully extended position, ratchet spring 66 is allowed to push said ratchet 67 which engages ratchet gear 46 and ratchet gear 43. FIG. 10 shows that when the ratchet button 65 is in the depressed position, ratchet spring 66, which is attached to ratchet 67, is compressed by ratchet 67, so ratchet 67 does not engage said ratchet gear 46 and ratchet gear 43. The said ratchet button 65 is able to be locked in the depressed position.

Figure 6:
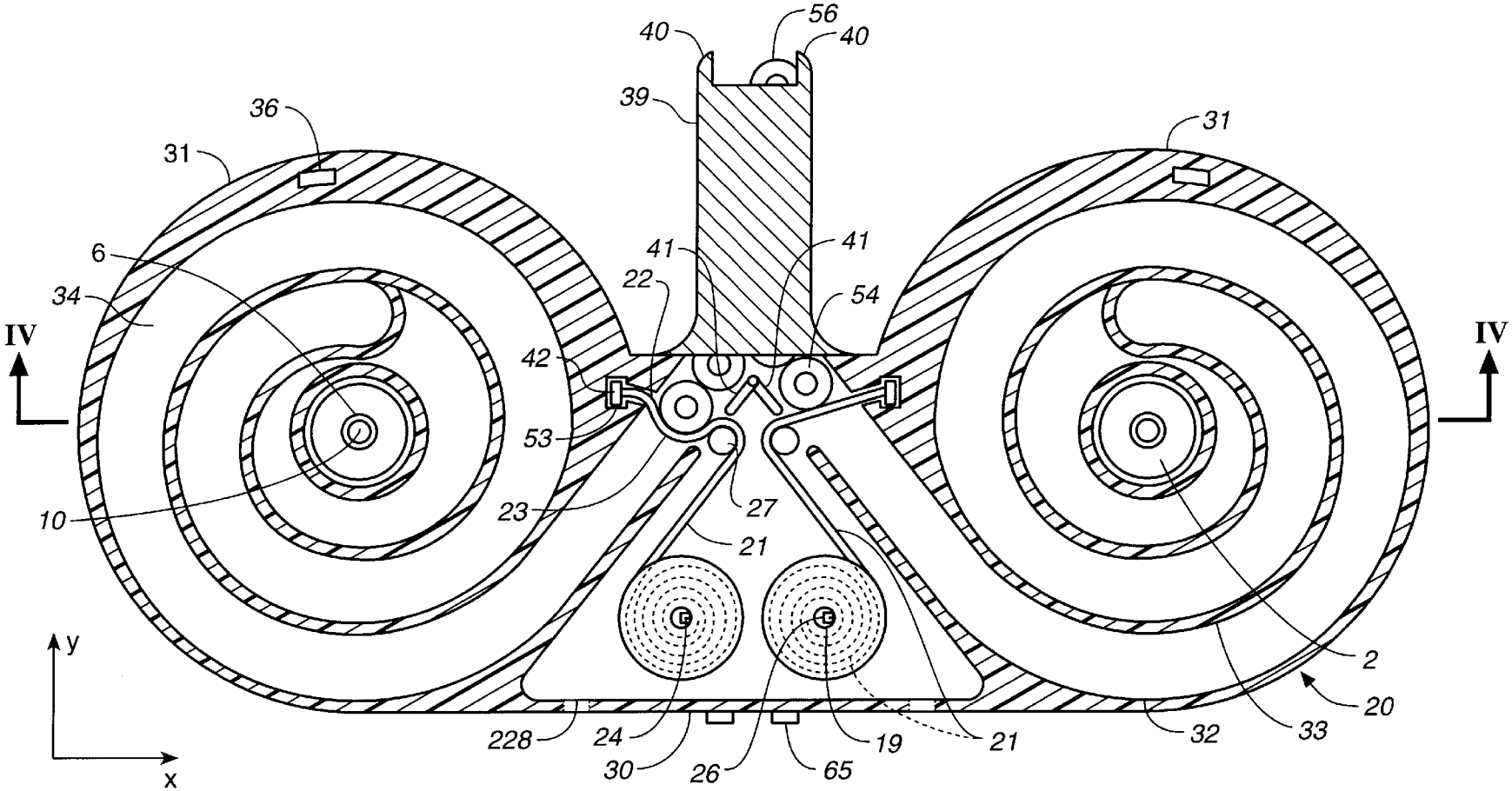
FIG. 6 is a vertical rear view along line I—I of FIG. 1 showing the double drum magazine alone of the invention with ammunition path exposed and magazine embodiment fully loaded.
Figure 7:
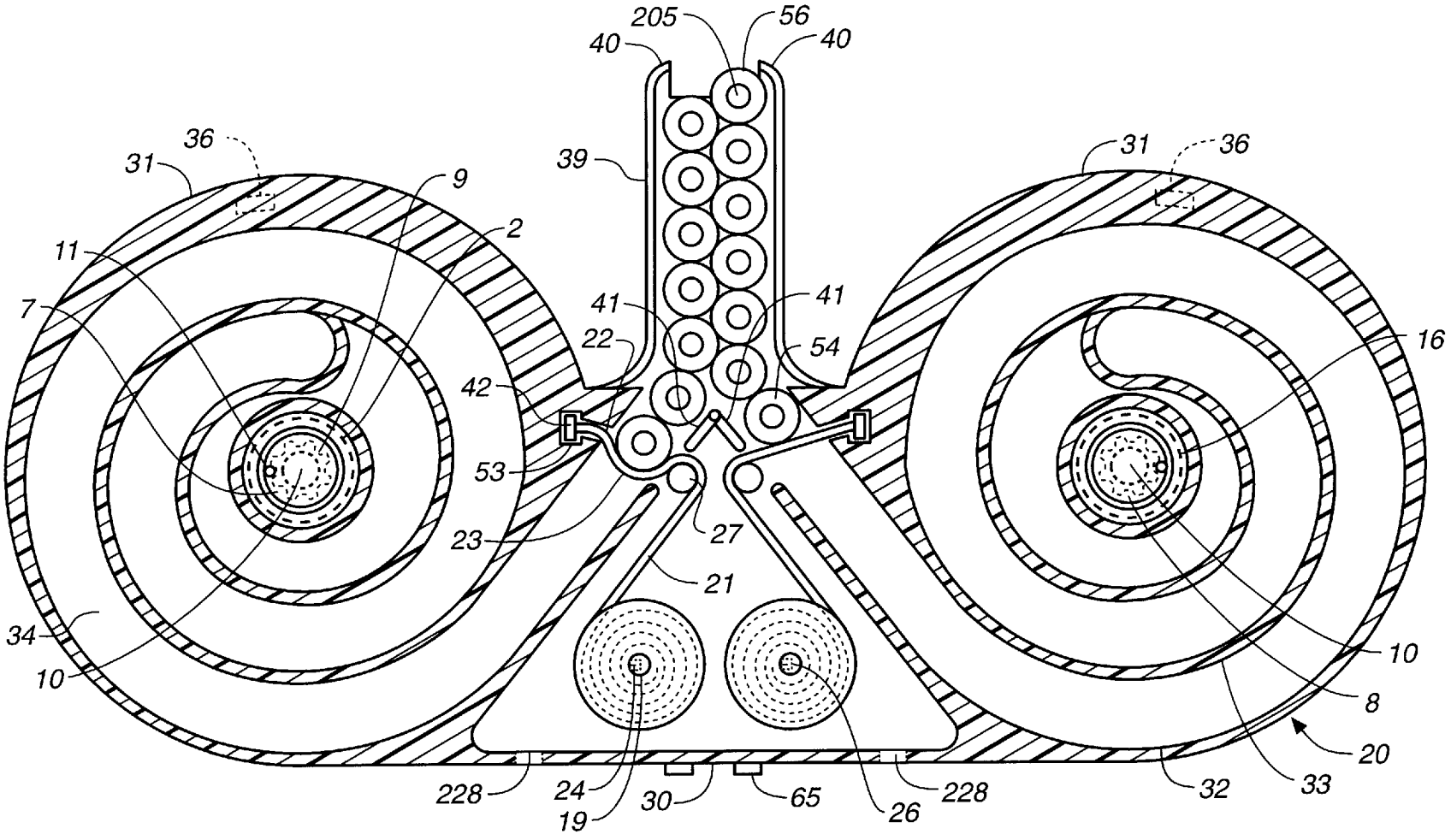
FIG. 7 is a vertical view cross section along line II—II of FIG. 2 showing the double drum magazine alone of the invention with ammunition path exposed and magazine embodiment fully unloaded.

Rotating axle 19 is rotatibly mounted in magazine 20. FIG. 6 shows that belt end receptacle 26 located on rotating axle 19, attaches to end piece of ammunition belt 24, which is part of ammunition belt 21. FIG. 11 shows that axle gear (or windup gear) 50 is mounted on rotating axle 19 in such a manner that the axle gear 50 is fixed to the rotating axle 19 in the x direction and in the y direction. Axle gear 50 is allowed to move in the z direction. Position of the axle gear 50 is directed by the transition gear button 62 and axle gear push spring 51. The position of free gear 45 on the z axis determine the position of ratchet 67. Ratchet 67 determines the position of axle gear 50 by restricting the position of axle gear 50 in the −z direction while the axle gear push spring 51 restricts position of said axle gear 50 in the +z direction and applies a force on axle gear 50 in the −z direction. Said axle gear 50 rotates with the same angular acceleration and same angular velocity as rotating axle 19.

Front magazine cover 17 holds the driving mechanism and transmission system in place and is attached to the magazine and is removable. As the rotating axle 19 turns, the ammunition belt 21 is wound on said rotating axle 19 or unwound from said rotating axle 19. When said ammunition belt 21 is wound or unwound on rotating axle 19 the belt is moved around idler roller 27 which is rotatibly mounted in magazine 20. On the other end of the ammunition belt 21 is the end piece of ammunition belt 42 which is part of ammunition belt 21. The end piece of ammunition belt 42 is attached to belt end receptacle 53, which is part of said magazine 20 so end piece of ammunition belt 42 is fixedly attached to magazine 20.

Figure 4:
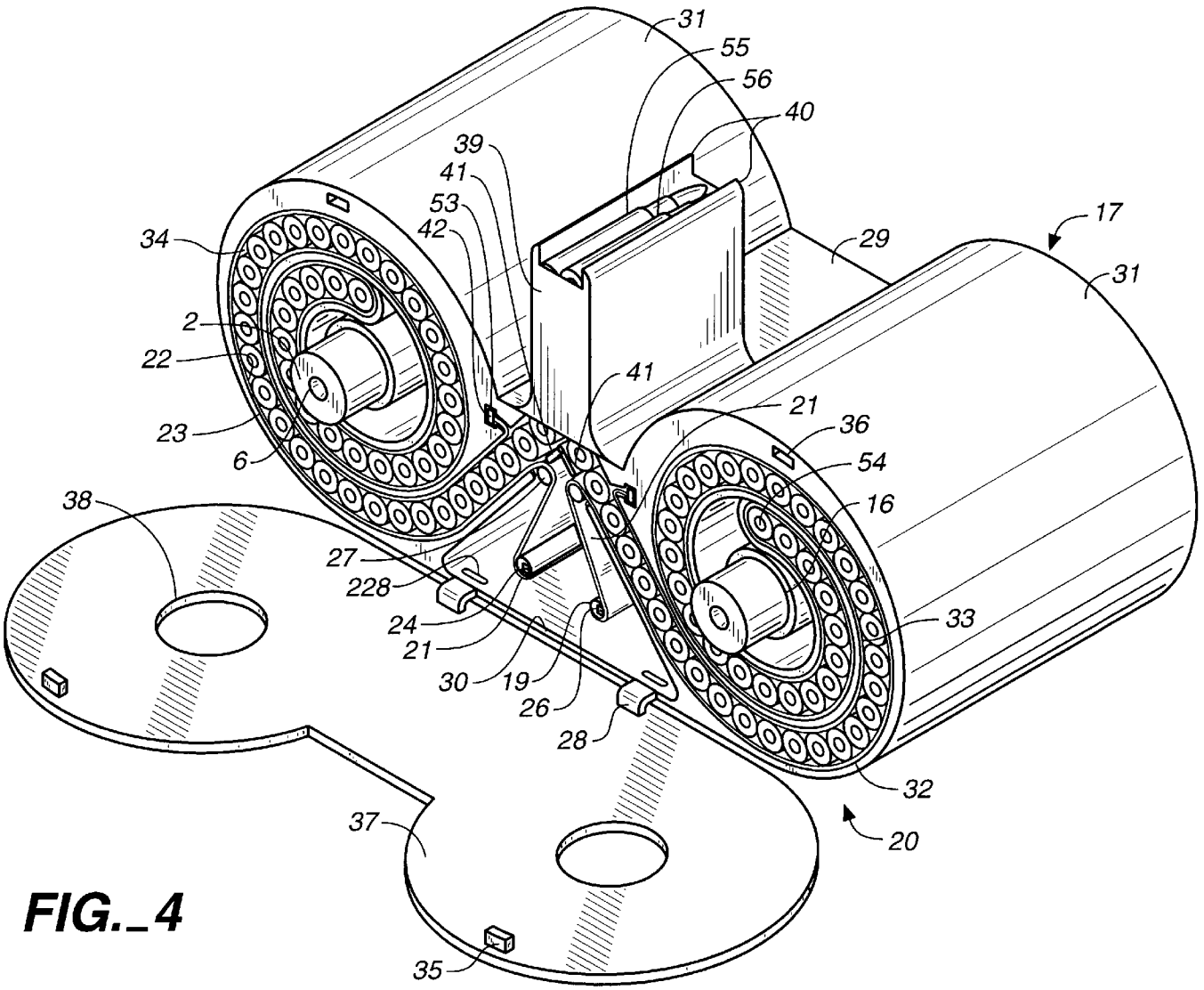
FIG. 4 is a perspective view taken along line I—I of FIG. 1 showing the double drum magazine alone of the invention with ammunition path exposed and magazine embodiment fully loaded.
Figure 5:
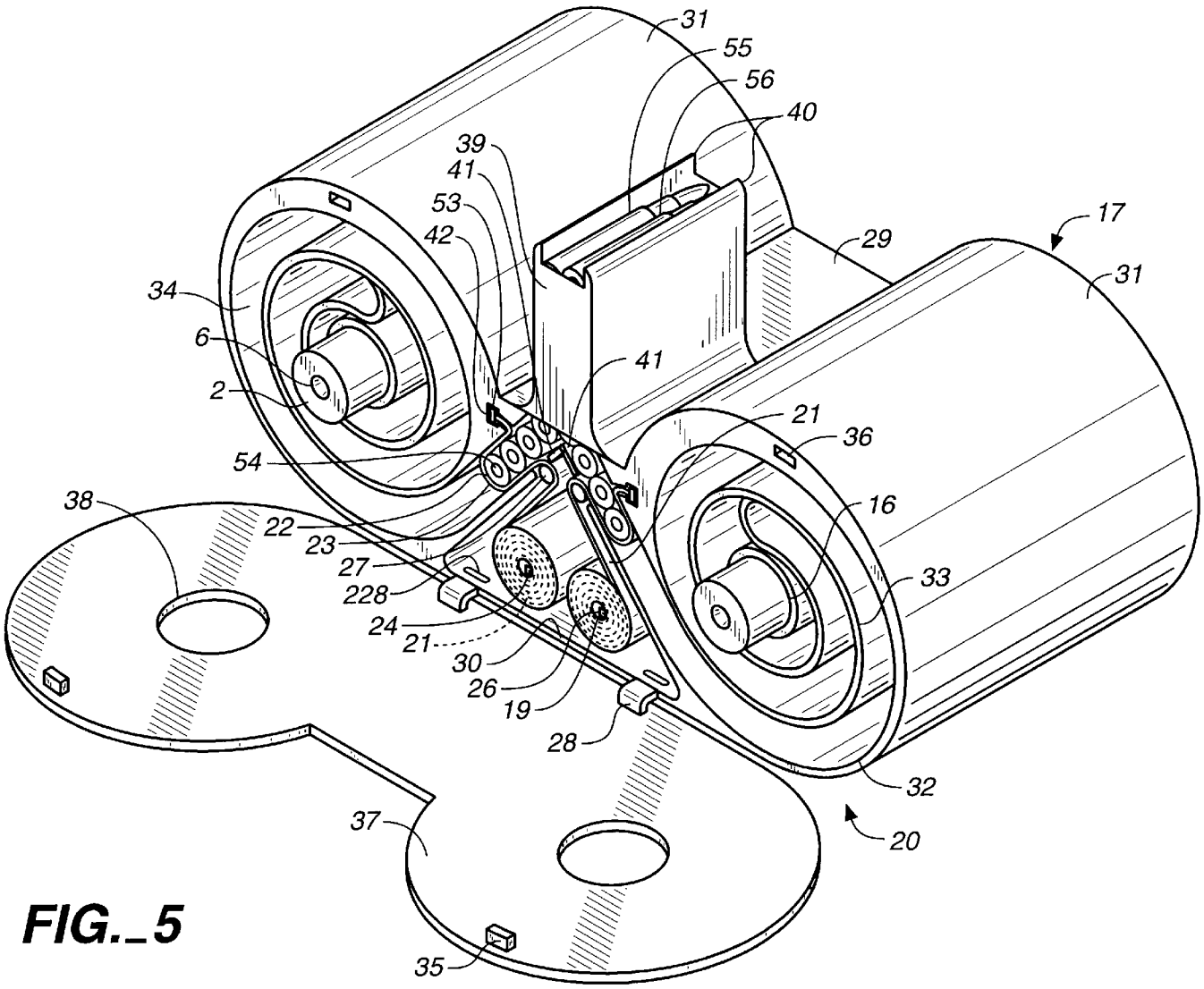
FIG. 5 is a perspective view taken along line I—I of FIG. 1 showing the double drum magazine alone of the invention with ammunition path exposed and magazine embodiment partially loaded.
Figure 15:
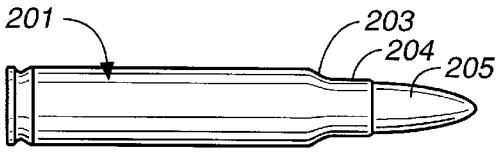
FIG. 15 shows a side view of a necked cartridge.
Figure 16:
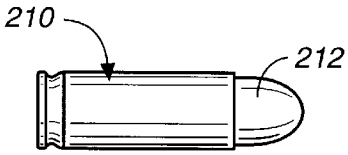
FIG. 16 shows a side view of an unnecked cartridge.
Figure 17:
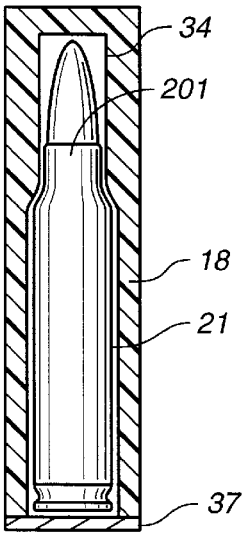
FIG. 17 shows a vertical view in cross section of a small portion of magazine and ammunition belt which contains single stacked necked cartridges.
Figure 18:
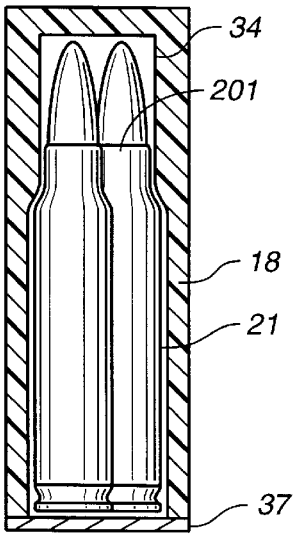
FIG. 18 shows a vertical view in cross section of a small portion of magazine and ammunition belt which contains double stacked necked cartridges of the invention.
Figure 19:
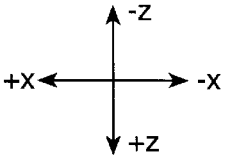
FIG. 19 shows a vertical view in cross section of a small portion of magazine and ammunition belt which contains single stacked cartridges of the invention.
Figure 19:
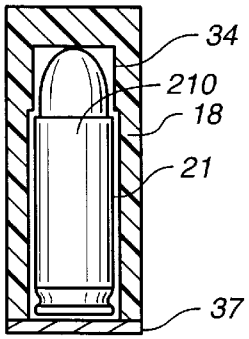
Figure 20:
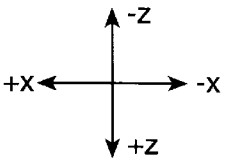
FIG. 20 shows a vertical rear view in cross section of a small portion of magazine and ammunition belt which contains double stacked unnecked cartridges of the invention.
Figure 20:
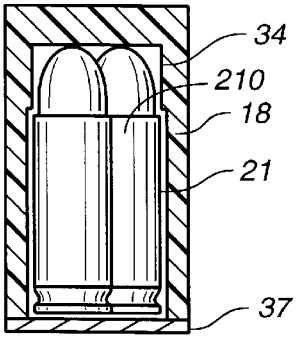
Figure 21:
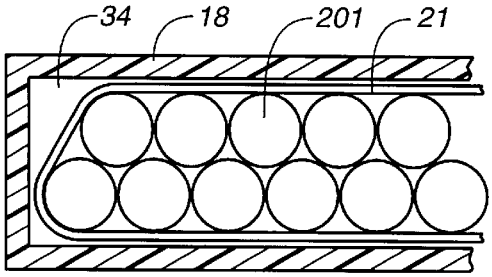
FIG. 21 shows a vertical rear view in cross section of a small portion of magazine and ammunition belt which contains double stacked necked cartridges.
Figure 22:
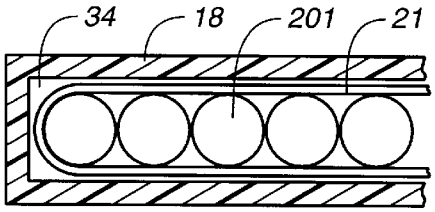
FIG. 22 shows a vertical rear view in cross section of a small portion of the magazine and ammunition belt which contains single stacked necked cartridges.
Figure 23:
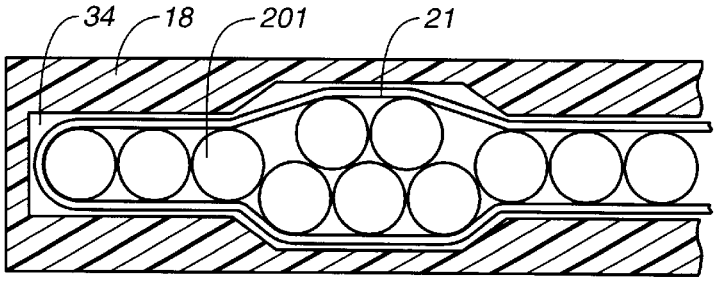
FIG. 23 shows a vertical rear view in cross section of a small portion of the magazine and ammunition belt which contain both double and single stacked necked cartridges.
Figure 24:
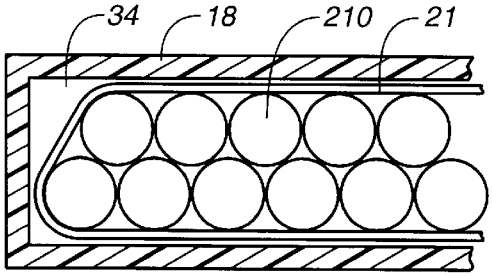
FIG. 24 shows a vertical view in cross section of a small portion of magazine and ammunition belt which contains double stacked unnecked cartridges.
Figure 25:
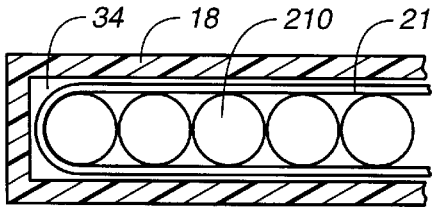
FIG. 25 shows a vertical rear view in cross section of a small portion of the magazine and ammunition belt which contains single stacked unnecked cartridges.
Figure 26:
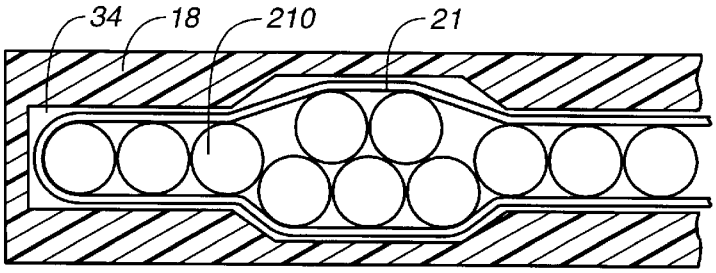
FIG. 26 shows a vertical rear view in cross section of a small portion of the magazine and ammunition belt which contain both double and single stacked unnecked cartridges.

FIG. 4 shows that when ammunition is loaded into the magazine in such a manner that they are held in compression by the belt, then the lead cartridge 56 is being pushed by the top cartridge 55 against one or both lips of the double lip feed throat (or cartridge feed extension exit) 40. FIG. 5 shows the ammunition band 21 while carrying the ammunition is limited to guide path 34, which is made up of a series (of) arcs with a linear section near the cartridge feed extension 39. (The housing is the part of the magazine that encompasses said guide path 34. The outside surface of the housing is the housing surface.) FIG. 17 shows guide wall 18 supports the neck of the cartridge 204 and/or shoulder of the cartridge 203 and/or bullet 205 to restrict the position of the cartridge 201 from moving in the −z direction. FIG. 18 shows guide wall 18 supports the neck of the cartridge 204 and/or shoulder of the cartridge 203 and/or bullet 205 to restrict the position of the cartridge 201, from FIG. 15, from moving in the −z direction. FIGS. 21, 22, 23 all show guide wall 18 supports and guides cartridge 201. FIG. 19 shows guide wall 18 supports the cartridge 210 and bullet 212 to restrict the position of the cartridge 210 from moving in the −z direction. FIG. 20 shows guide wall 18 supports the cartridge 210 and bullet 212 to restrict the position of the cartridge 210, from FIG. 16, from moving in the −z direction. FIGS. 24, 25, 26 all show guide wall 18 supports and guides cartridge 201.

Figure 3:
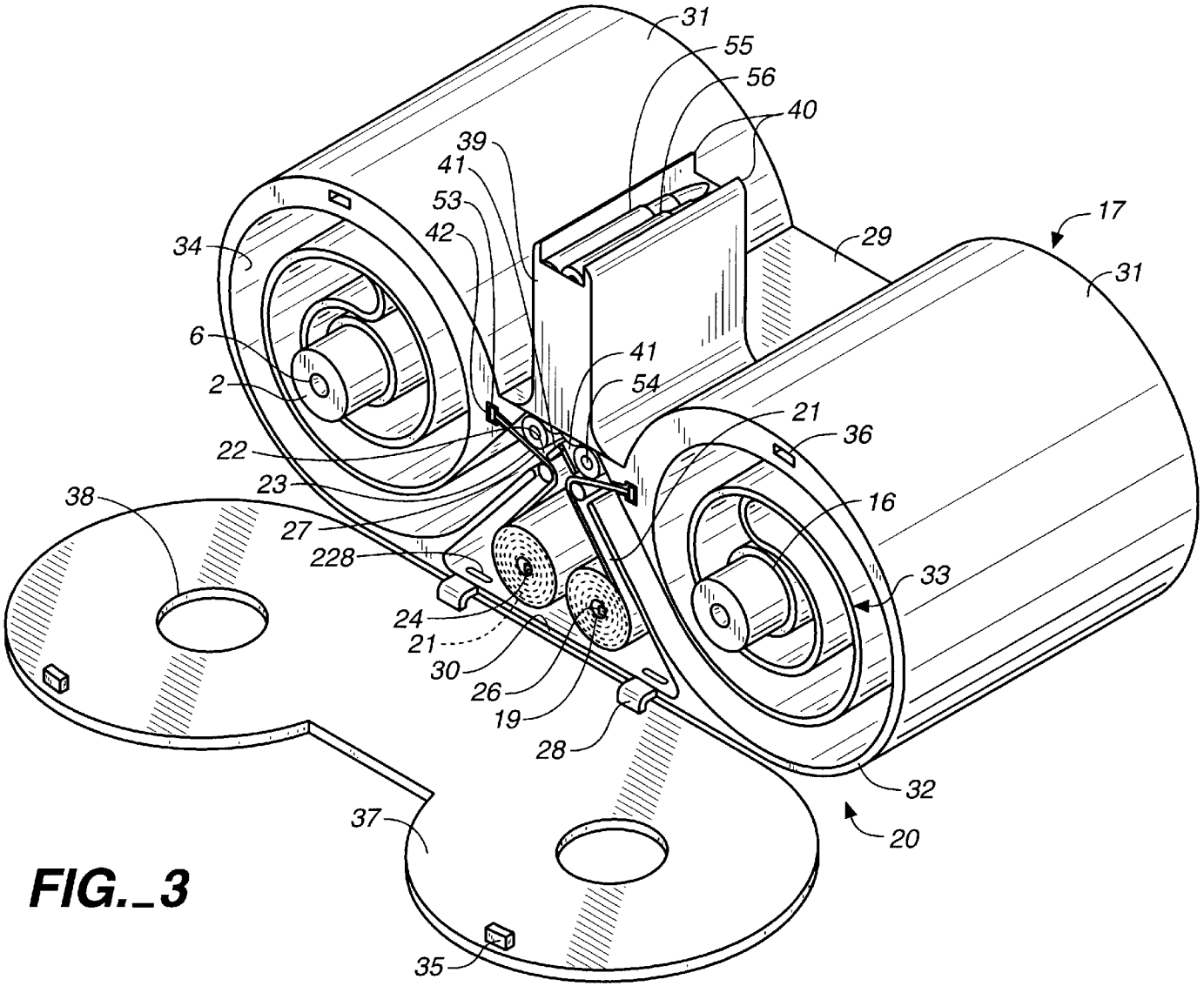
FIG. 3 is a perspective view taken along line I—I of FIG. 1 showing the double drum magazine alone of the invention with ammunition path exposed and magazine embodiment fully unloaded.

FIG. 11 shows rear magazine cover 37 restricts the +z direction of the ammunition belt 21 and ammunition when said rear magazine cover 37 is closed and cover locking means 35 engages cover receptacle 36. FIG. 3 shows said rear magazine cover 37 has rear turning handle hole 38 and is engaged to lower connection means 30 of magazine 20 with cover catch 28 engaging cover hold 228. When the ammunition belt 21 is held in tension it pulls rear cartridge 54 and surrounds all cartridges up to the point between the idler roller 27 and belt end receptacle 53. FIG. 6 shows the cartridges are restricted to moving (in the spiral or guide cavity) in the x direction and/or y direction (bounded) by the outside guide wall (surface) 32, inside guide wall 33. The ammunition belt 21 is therefor folded into a loop that extends into the spiral or guide cavity and cradles the cartridges which are aligned on the belt side by side with a long dimension of cartridges substantially perpendicular to the edges of the belt. As the ammunition belt is withdrawn from the spiral or guide cavity, past the spiral or guide exit, as the said windup axle rotates in a windup direction, the ammunition is pushed toward the double feed lip throat. When the windup axle rotates in the opposite direction to the windup direction the windup axle rotates in the release direction. The cartridges from each drum portion 31 come together into a double stack in the cartridge feed extension 39 guided by cartridge merging guide 41. Said outside guide wall 32 and inside guide wall 33 contacts ammunition belt outside wall 23. The ammunition belt inside wall 22 contacts cartridges loaded in the magazine.

The typical procedure for operating the magazine is as follows: First disengage and discharge said drive spring 12 from ammunition belt 21 by linearly moving main shaft 10 in the −z direction or by linearly moving the transition gear button 62 in the +z direction. When said drive spring 12 disengages, the main gear 13 disengages transfer gear 15 and engages free gear 45. When ratchet 67 does not engage ratchet gear 46, free gear 45 allows controlled discharge of drive spring 12 since free gear 45 offers resistance to main gear 13 rotation.

After said drive spring is discharged the main gear 13 should be in the most +z direction such that (inward facing gear coupling) 8 engages (outward facing gear coupling) 9 and transition gear button 62 is locked in the depressed position such that main gear 13 engages free gear 45. Rear magazine cover 37 can be opened by releasing cover locking means 35 from cover receptacle 36. After the rear magazine cover 37 is opened, ammunition band 21 can be pulled along guide path 34 away from double lip feed throat 40 until the band reaches the end of the said guide path 34. This can be done easiest by inserting a cartridge from the rear of the magazine, in guide path 34, in such a manner that the cartridge contacts ammunition belt inside wall 22 and pulling cartridge along guide path 34. Cartridges can then be inserted bullet end first in the magazine in such a manner that all cartridges, including dummy cartridges, which are to be moved by the ammunition belt 21 to the double lip feed throat 40, are placed from the rear of the magazine, in both guide path 34 and all cartridges contact ammunition belt inside wall 22.

Figure 8:
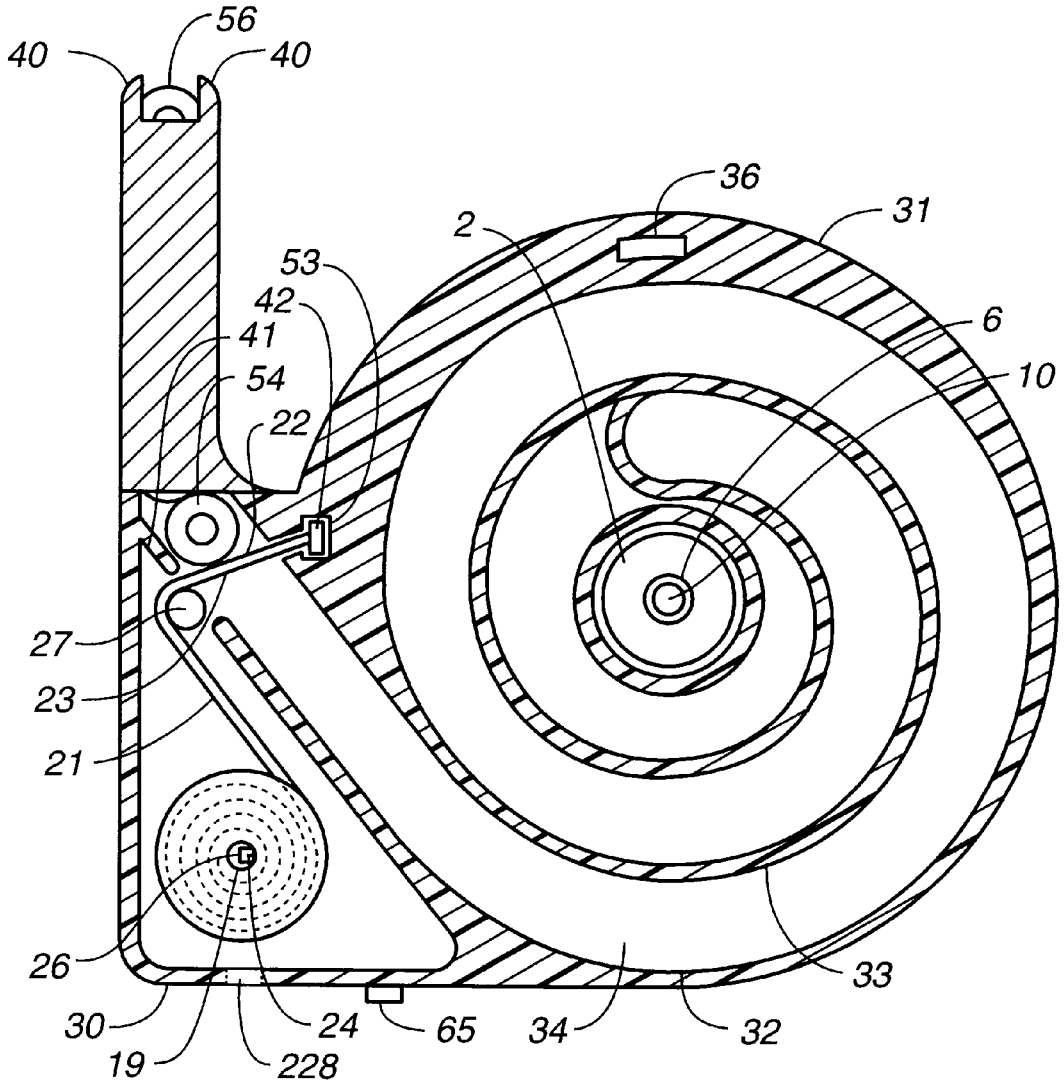
FIG. 8 is a vertical view of a single drum magazine embodiment of the present invention.
Figure 14:
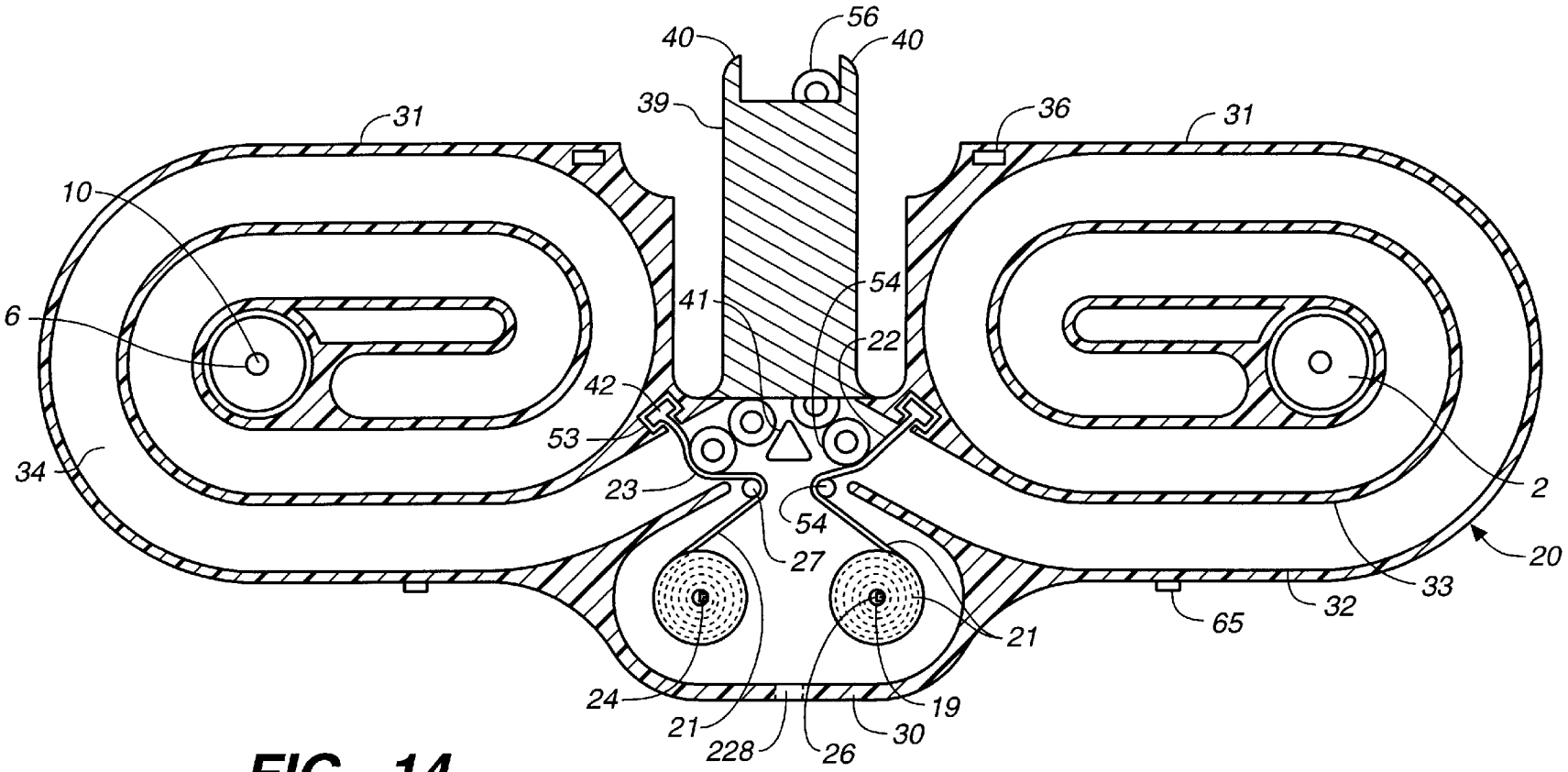
FIG. 14 is a vertical rear view of an elliptical magazine

As can be seen in FIG. 6, FIG. 14, and FIG. 8, the ammunition belt 21 does not extend to the cartridge feed extension 39, therefore, it is necessary that said cartridge feed extension 39 be filled with cartridges, which can be dummy cartridges 80. The number of dummy cartridges depends on the cartridge feed extension 39. When dummy cartridges are used they must be moved to the end guide path 34 and be in contact with ammunition belt inside wall 22, in such a manner, that they are behind all live cartridges which are to be moved to the double feed throat 40. After live cartridges and dummy cartridges are positioned in the proper manner described previously, said rear magazine cover 37 can be closed with cover catch 28 engaging cover hole 228 and engaging cover locking means 35 with cover receptacle 36. After rear magazine cover 37 is closed the ratchet button 65 should be released to engage ratchet 67 with ratchet gear 43 and ratchet gear 46. After ratchet 67 is engaged, front turning handle 3 or rear turning handle 2 can be turned in the direction which the ratchet allows it to rotate in a spring load direction and preventing said turning handle 2 or said turning handle 3 from rotating in a spring unload direction. As seen on FIG. 11, when looking at the magazine from the rear, the direction which front turning handle 3 or rear turning handle 2 is turned counter clockwise on the right side of the magazine and turned clockwise on the left side of the magazine. As seen in FIG. 11, after the drive spring 12 is charged, the transition gear button 62 should be placed in the released position such that main gear 13 engages transfer gear 15. Ratchet button 65 should be placed in the released position for ratchet 67 to be disengaged from ratchet gear 43 and ratchet gear 46. When ratchet 67 is disengaged from ratchet gear 43 and ratchet gear 46, the drive spring 12, when charged, causes rotating axle 19 to rotate in the clockwise direction on the right side of the magazine and counter clockwise on the left side of the magazine. FIG. 6 shows when rotating axle 19 rotates, ammunition band 21 is wound around said rotating axle 19 and pulls rear cartridge 54 toward double lip feed throat 40. All of the live cartridges can be ejected through double lip feed throat 40. The live cartridges can also be extracted from the rear when said drive spring 12 is disengaged and discharged and rear magazine cover 37 is open. The magazine may alternatively be loaded by inserting cartridges into said double lip feed throat 40, while rear magazine cover 37 is closed. For each cartridge loaded into double lip feed throat 40, the cartridges in cartridge feed extension 39 will be pushed downward toward the cartridge merging guide 41 splitting the staggered row of cartridges. Cartridges are pushed into each of the drum portions 31. Drive spring 12 should be engaged with rotating axle 19 and ratchet button 65 should be in the depressed position when loading the magazine in the alternative manner.

The magazine of the present invention may be made of any suitable materials, such as metals and plastics. Ideally, the drums and connections will be formed as a one piece plastic in a molding process, with as many other parts as appropriate made of plastic, to produce the lightest possible product consistent with durability and reliable operation. A portion of the magazine is made of transparent material so that the inside of the magazine is visible. Any implementation of the invention should be appropriately sized based on the dimensions of the cartridges to be stored therein.

While the invention has been described in detail with particular reference to the preferred embodiments thereof, it will be understood that variations and modifications can be effected within the spirit and scope of the invention as previously described and as defined by the claims.

What is claimed is:

1. A magazine for successively feeding a plurality of cartridges to a firearm, comprising:

a housing having a housing wall and a pair of end plates facing one another with a guide wall interposed between said end plates whereby a single guide cavity is defined in said housing;

said guide cavity having a guide exit at an end of the guide wall leading to outside said housing;

said guide cavity, defined between said guide wall, is a continuous path that never intersects itself with two ends;

a windup shaft journaled in said housing and extending between said end plates and positioned outside said guide cavity proximal to said guide exit; an ammunition belt having one end coupled to said windup shaft and forming a loop with one section of said loop extending from said windup shaft into said guide cavity toward opposite exit end of said guide cavity and joining another section of said loop extending into said guide cavity to a far end of said loop secured to said housing proximal to said windup shaft;

said loop cradling the plurality of cartridges between said one section and said another section of said loop with the cartridges arranged side by side on said belt and with a long dimension of each cartridge oriented substantially perpendicular to elongated edges of said belt operably arranged to permit that, when said windup shaft is rotated in a windup direction, said loop is shortened and withdrawn from said guide cavity drawing each cartridge of said plurality of cartridges in succession out of said guide cavity and when said windup shaft is rotated in a release direction, said ammunition belt is unwound from said windup shaft permitting said ammunition belt to be extended into said guide cavity and allowing said magazine to be loaded with a plurality of cartridges;

said ammunition belt is at least partially made of plastic;

a driving means coupled to said windup shaft for turning said windup shaft;

means for attaching said housing to said firearm operably arranged to enable said magazine to deliver successively each one cartridge of said plurality of cartridges to said firearm.

2. The magazine of claim 1 wherein said guide cavity is at least partially one of a linear format.

3. The magazine of claim 1 wherein said driving means comprises:

a main shaft rotatably mounted in said housing;

a spring coupled to said main shaft having one end coupled to said main shaft and another end coupled to said housing;

a transmission means for coupling said spring to said windup shaft.

4. The magazine of claim 3 wherein said transmission means is:

(a) arrangeable in one setting for disengaging said spring from said windup shaft;

(b) arrangeable in another setting for engaging said spring to said windup shaft.

5. The magazine of claim 3 wherein said transmission means comprises:

a windup gear mounted on said windup shaft;

a main gear mounted on said main shaft;

a transmission gear means, for transmitting power from said main gear to said windup gear, slidably mounted for movement to one location where said transmission gear means allows the said main gear to be coupled to said windup gear, in another location said main gear is uncoupled from said windup gear.

6. The magazine of claim 3 comprising:

a load axle means rotatably mounted on said housing and coupled to said main shaft for loading said spring;

a handle means for turning said load axle means mounted on said load axle means;

a ratchet gear mounted to rotate with said load axle means and coupled to said main gear;

ratchet means for permitting said handle to rotate in a spring load direction and preventing said handle from rotating in a spring unload direction;

button means for releasing said ratchet means from said ratchet gear to permit said main shaft to rotate in said unload direction.

7. The magazine of claim 1 comprising:

cartridge feed extension means associated with said housing means and defining a cartridge feeding channel in communication with the guide exit opening of said housing means.

8. The magazine of claim 1 wherein at least a portion of said housing is of a transparent material so that the interior of the said housing is visible.

9. A magazine for successively feeding a plurality of cartridges to a firearm, comprising:

a housing having a housing wall and a pair of end plates facing one another with a guide wall interposed between said end plates whereby a single guide cavity is defined in said housing;

said housing is at least partially made of plastic;

said guide cavity having a guide exit at an end of the guide walls leading to outside said housing;

said guide cavity, defined between said guide wall, is a continuous path that never intersects itself with two ends;

a windup shaft journaled in said housing and extending between said end plates and positioned outside said guide cavity proximal to said guide exit;

an ammunition belt having one end coupled to said windup shaft and forming a loop with one section of said loop extending from said windup shaft into said guide cavity toward opposite exit end of said guide cavity and joining another section of said loop extending into of said guide cavity to a far end of said loop secured to said housing proximal to said windup shaft;

said loop cradling the plurality of cartridges between said one section and said another section of said loop with the cartridges arranged side by side on said belt and with a long dimension of each cartridge oriented substantially perpendicular to elongated edges of said belt operably arranged to permit that, when said windup shaft is rotated in a windup direction, said loop is shortened and withdrawn from said guide cavity drawing each cartridge of said plurality of cartridges in succession out of said guide cavity and when said windup shaft is rotated in a release direction, said ammunition belt is unwound from said windup shaft permitting said ammunition belt to be extended into said guide cavity and allowing said magazine to be loaded with a plurality of cartridges;

a driving means coupled to said windup shaft for turning said windup shaft;

means for attaching said housing to a firearm operably arranged to enable said magazine to deliver successively each one cartridge of said plurality of cartridges to said firearm.

10. The magazine of claim 9 wherein said spiral cavity is at least partially one of a linear format.

11. The magazine of claim 9 wherein said driving means comprises:

a main shaft rotatably mounted in said housing;

a spring coupled to said main shaft having one end coupled to said main shaft and another end coupled to said housing;

a transmission means for coupling said motor to said windup shaft.

12. The magazine of claim 11 wherein said transmission means is:

(a) arrangeable in one setting for disengaging said spring from said windup shaft;

(b) arrangeable in another setting for engaging said spring to said windup shaft.

13. The magazine of claim 11 wherein said transmission means comprises:

a windup gear mounted on said windup shaft;

a main gear mounted on said main shaft;

a transmission gear means, for transmitting power from said main gear to said windup gear, slidably mounted for movement to one location where said transmission gear means allows the said main gear to be coupled to said windup gear, in another location said main gear is uncoupled from said windup gear.

14. The magazine of claim 11 comprising:

a load axle means rotatably mounted on said housing and coupled to said motor shaft for loading said spring;

a handle means for turning said load axle means mounted on said load axle means;

a ratchet gear mounted to rotate with said load axle means and coupled to said main gear;

ratchet means for permitting said handle to rotate in a spring load direction and preventing said handle from rotating in a spring unload direction;

button means for releasing said ratchet means from said ratchet gear to permit said main shaft to rotate in said unload direction.

15. The magazine of claim 9 comprising:

cartridge feed extension means associated with said housing means and defining a cartridge feeding channel in communication with the guide exit opening of said housing means.

16. The magazine of claim 9 wherein at least a portion of said housing is of a transparent material so that the interior of the said housing is visible.

17. The magazine of claim 16 wherein said guide cavity is at least partially one of a linear format.

18. The magazine of claim 17 wherein said transmission means is:

(a) arrangeable in one setting for disengaging said spring from said windup shaft;

(b) arrangeable in another setting for engaging said spring to said windup shaft.

19. The magazine of claim 17 wherein said transmission means comprises:

a windup gear mounted on said windup shaft;

a main gear mounted on said main shaft;

a transmission gear means, for transmitting power from said main gear to said windup gear, slidably mounted for movement to one location where said transmission gear means allows the said main gear to be coupled to said windup gear, in another location said main gear is uncoupled from said windup gear.

20. The magazine of claim 17 comprising:

a load axle means rotatably mounted on said housing and coupled to said main shaft for loading said spring;

a handle means for turning said load axle means mounted on said load axle means;

a ratchet gear mounted to rotate with said load axle means and coupled to said main gear;

ratchet means for permitting said handle to rotate in a spring load direction and preventing said handle from rotating in a spring unload direction;

button means for releasing said ratchet means from said ratchet gear to permit said main shaft to rotate in said unload direction.

21. The magazine of claim 16 wherein said driving means comprises:

a main shaft rotatably mounted in said housing;

a spring coupled to said main shaft having one end coupled to said main shaft and another end coupled to said housing;

a transmission means for coupling said spring to said windup shaft.

22. The magazine of claim 16 comprising:

cartridge feed extension means associated with said housing means and defining a cartridge feeding channel in communication with the guide exit opening of said housing means.

23. A magazine for successively feeding a plurality of cartridges to a firearm, comprising:

a housing having a housing wall and a pair of end plates facing one another with a pair of guide walls interposed between said end plates whereby a pair of guide cavities are defined in said housing;

each of said guide cavities having a guide exit at an end of said respective guide wall leading to outside said housing;

said guide cavity, defined between said guide wall, is a continuous path that never intersects itself with two ends;

a pair of windup shafts journaled in said housing and extending between said end plates with one of said pair of windup shafts proximal to one said guide exit and the other of said pair of windup shafts proximal to said other guide exit with both windup shafts positioned outside said guide cavities;

a pair of ammunition belts one of said pair of ammunition belts for each guide cavity and each ammunition belt having one end coupled to one of said windup shafts respectively and forming a loop with one section of said loop extending from said windup shaft into said respective guide cavity toward respective opposite exit end of said guide cavity and joining another section of said loop extending into of said guide cavity to a far end of said loop secured to said housing proximal to said windup shaft;

each said loop cradling the plurality of cartridges between said one section and said another section of said respective loop with the cartridges arranged side by side on said respective belt and with a long dimension of each cartridge oriented substantially perpendicular to elongated edges of said respective belt operably arranged to permit that, when said respective windup shaft is rotated in a windup direction, said respective loop is shortened and withdrawn from said respective guide cavity drawing each cartridge of said plurality of cartridges in succession out of said respective guide cavity and when said respective windup shaft is rotated in a release direction, said respective ammunition belt is unwound from said windup shaft permitting said ammunition belt to be extended into said respective guide cavity and allowing said magazine to be loaded with a plurality of cartridges;

a driving means coupled to said windup shaft for turning said windup shaft;

means for attaching said housing to said firearm operably arranged to enable said magazine to deliver successively each one cartridge of said plurality of cartridges to said firearm.

24. A magazine for successively feeding a plurality of cartridges to a firearm, comprising:

a housing having a housing wall and a pair of end plates facing one another with a spiral wall interposed between said end plates whereby a single substantially spiral cavity is defined in said housing;

said spiral cavity having a guide exit at an end of the spiral wall leading to outside said housing;

said spiral cavity is a continuous path with two ends, defined between the guide wall, about a central region;

a windup shaft journaled in said housing and extending between said end plates and positioned outside said spiral cavity proximal to said spiral exit;

an ammunition belt having one end coupled to said windup shaft and forming a loop with one section of said loop extending from said windup shaft into said spiral cavity toward opposite exit end of said spiral cavity and joining another section of said loop extending into said spiral cavity to a far end of said loop secured to said housing proximal to said windup shaft;

said loop cradling the plurality of cartridges between said one section and said another section of said loop with the cartridges arranged side by side on said belt and with a long dimension of each cartridge oriented substantially perpendicular to elongated edges of said belt operably arranged to permit that, when said windup shaft is rotated in a windup direction, said loop is shortened and withdrawn from said spiral cavity drawing each cartridge of said plurality of cartridges in succession out of said spiral cavity and when said windup shaft is rotated in a release direction, said ammunition belt is unwound from said windup shaft permitting said ammunition belt to be extended into said spiral cavity and allowing said magazine to be loaded with a plurality of cartridges;

said ammunition belt is at least partially made of plastic;

a driving means coupled to said windup shaft for turning said windup shaft;

means for attaching said housing to said firearm operably arranged to enable said magazine to deliver successively each one cartridge of said plurality of cartridges to said firearm.

25. A magazine for successively feeding a plurality of cartridges to a firearm, comprising:

a housing having a housing wall and a pair of end plates facing one another with a guide wall interposed between said end plates whereby a single guide cavity is defined in said housing;

said guide cavity having a guide exit at an end of the guide walls leading to a cartridge feed extension;

cartridge feed extension associated with said housing and defining a cartridge feeding channel in communication with the guide exit opening of said housing means;

said guide cavity, defined between said guide wall, is a continuous path that never intersects itself with two ends;

a windup shaft journaled in said housing and extending between said end plates and positioned outside said guide cavity proximal to said guide exit, an ammunition belt having one end coupled to said windup shaft and forming a loop with one section of said loop extending from said windup shaft into said guide cavity toward opposite exit end of said guide cavity and joining another section of said loop extending into said guide cavity to a far end of said loop secured to said housing proximal to said windup shaft;

said loop cradling the plurality of cartridges between said one section and said another section of said loop with the cartridges arranged side by side on said belt and with a long dimension of each cartridge oriented substantially perpendicular to elongated edges of said belt operably arranged to permit that, when said windup shaft is rotated in a windup direction, said loop is shortened and withdrawn from said guide cavity drawing each cartridge of said plurality of cartridges in succession out of said guide cavity and when said windup shaft is rotated in a release direction, said ammunition belt is unwound from said windup shaft permitting said ammunition belt to be extended into said guide cavity and allowing said magazine to be loaded with a plurality of cartridges;

a driving means coupled to said windup shaft for turning said windup shaft;

means for attaching said housing to said firearm operably arranged to enable said magazine to deliver successively each one cartridge of said plurality of cartridges to said firearm.

26. A magazine for successively feeding a plurality of cartridges to a firearm, comprising:

a housing having a housing wall and a pair of end plates facing one another with a guide wall interposed between said end plates whereby a single spiral cavity is defined in said housing;

said spiral cavity having a spiral exit at an end of the guide wall leading to a cartridge feed extension outside said housing;

said spiral cavity is a continuous path with two ends, defined between the guide wall, about a central region;

said housing having an exit from said cartridge feed extension to outside said cartridge feed extension;

a windup shaft journaled in said housing and extending between end plates and positioned outside said spiral cavity proximal to said spiral exit;

an ammunition belt having one end coupled to said windup shaft and forming a loop with one section of said loop extending from said windup shaft into said spiral cavity toward opposite exit end of said spiral cavity and joining another section of said loop extending into said spiral cavity to a far end of said loop secured to said housing proximal to said windup shaft;

said loop cradling the plurality of cartridges between said one section and said another section of said loop with the cartridges arranged side by side on said belt and with a long dimension of each cartridge oriented substantially perpendicular to elongated edges of said belt operably arranged to permit that, when said windup shaft is rotated in a windup direction, said loop is shortened and withdrawn from said spiral cavity drawing each cartridge of said plurality of cartridges in succession out of said spiral cavity, through said cartridge feed extension and out of said cartridge feed extension exit and when said windup shaft is rotated in a release direction, said ammunition belt is unwound from said windup shaft permitting said ammunition belt to be extended into said spiral cavity and allowing said magazine to be loaded with a plurality of cartridges;

a driving means coupled to said windup shaft for turning said windup shaft;

means for attaching said housing to said firearm operably arranged to enable said magazine to deliver successively each one cartridge of said plurality of cartridges through said cartridge feed extension exit to said firearm.

27. A magazine for successively feeding a plurality of cartridges to a firearm, comprising:

a housing having a housing wall and a pair of end plates facing one another with a guide wall interposed between said end plates whereby a single guide cavity is defined in said housing;

said guide cavity having a guide exit at an end of the guide wall leading to outside said housing;

said guide cavity, defined between said guide wall, is a continuous path that never intersects itself with two ends;

a windup shaft journaled in said housing and extending between said end plates and positioned outside said guide cavity proximal to said guide exit;

an ammunition belt having one end coupled to said windup shaft and forming a loop with one section of said loop extending from said windup shaft into said guide cavity toward opposite exit end of said guide cavity and joining another section of said loop extending into said guide cavity to a far end of said loop secured to said housing proximal to said windup shaft;

said loop cradling the plurality of cartridges between said one section and said another section of said loop with the cartridges arranged side by side on said belt and with a long dimension of each cartridge oriented substantially perpendicular to elongated edges of said belt operably arranged to permit that, when said windup shaft is rotated in a windup direction, said loop is shortened and withdrawn from said guide cavity drawing each cartridge of said plurality of cartridges in succession out of said guide cavity and when said windup shaft is rotated in a release direction, said ammunition belt is unwound from said windup shaft permitting said ammunition belt to be extended into said guide cavity and allowing said magazine to be loaded with a plurality of cartridges;

a driving means coupled to said windup shaft for turning said windup shaft;

means for attaching said housing to said firearm operably arranged to enable said magazine to deliver successively each one cartridge of said plurality of cartridges to said firearm.

28. A magazine for successively feeding a plurality of cartridges to a firearm, comprising:

a housing having a housing wall and a pair of end plates facing one another with a guide wall interposed between said end plates whereby a single spiral cavity is defined in said housing;

said spiral cavity having a guide exit at an end of the spiral wall leading to outside said housing;

said spiral cavity is a continuous path with two ends, defined between the guide wall, about a central region;

a windup shaft journaled in said housing and extending between said end plates and positioned outside said spiral cavity proximal to said spiral exit;

an ammunition belt having one end coupled to said windup shaft and forming a loop with one section of said loop extending from said windup shaft into said spiral cavity toward opposite exit end of said spiral cavity and joining another section of said loop extending into said spiral cavity to a far end of said loop secured to said housing proximal to said windup shaft;

said loop cradling the plurality of cartridges between said one section and said another section of said loop with the cartridges arranged side by side on said belt and with a long dimension of each cartridge oriented substantially perpendicular to elongated edges of said belt operably arranged to permit that, when said windup shaft is rotated in a windup direction, said loop is shortened and withdrawn from said spiral cavity drawing each cartridge of said plurality of cartridges in succession out of said spiral cavity and when said windup shaft is rotated in a release direction, said ammunition belt is unwound from said windup shaft permitting said ammunition belt to be extended into said spiral cavity and allowing said magazine to be loaded with a plurality of cartridges;

a driving means coupled to said windup shaft for turning said windup shaft;

means for attaching said housing to said firearm operably arranged to enable said magazine to deliver successively each one cartridge of said plurality of cartridges to said firearm.

* * * * *